US005699730A

United States Patent [19]

Ogier et al.

[11] Patent Number: 5,699,730

[45] Date of Patent: Dec. 23, 1997

[54] BAG SQUEEZER

[75] Inventors: Ray Ogier, Milton; Garry O'Donnell, Oakville, both of Canada

[73] Assignee: Chem Financial, Inc., Ontario, Canada

[21] Appl. No.: 630,785

[22] Filed: Apr. 10, 1996

[51] Int. Cl.[6] ..... B30B 7/04

[52] U.S. Cl. ..... 100/233; 100/264; 100/271; 222/105; 222/181.2; 222/203

[58] Field of Search ..... 100/122, 123, 100/233, 264, 269.2, 270, 271; 222/103, 105, 181.2, 181.3, 202, 203

[56] References Cited

U.S. PATENT DOCUMENTS

| | | | |
|---|---|---|---|
| Re. 25,799 | 6/1965 | Perdue . | |
| 31,027 | 1/1861 | Middleton . | |
| 600,203 | 3/1898 | Kellogg . | |
| 1,130,879 | 3/1915 | Berrigan | 100/122 |
| 1,131,032 | 3/1915 | Berrigan . | |
| 1,607,619 | 11/1926 | Hamilton | 100/271 |
| 2,419,330 | 4/1947 | Anderson | 100/233 |
| 2,843,331 | 7/1958 | Reeves . | |
| 2,858,051 | 10/1958 | Cunningham | 222/103 |
| 4,303,011 | 12/1981 | Reiner | 100/123 |
| 4,735,810 | 4/1988 | Dacal . | |
| 4,810,156 | 3/1989 | Pendleton et al. | 222/203 |
| 5,271,439 | 12/1993 | Alack | 222/203 |

*Primary Examiner*—Stephen F. Gerrity
*Attorney, Agent, or Firm*—Gifford, Krass, Groh, Sprinkle, Patmore, Anderson & Citkowski, P.C.

[57] ABSTRACT

A bag squeezing apparatus for breaking up bridging of material being delivered from the bag. A pair of jaws are sequentially operated to impact opposite sides of the bag.

15 Claims, 3 Drawing Sheets

BAG SQUEEZER

BACKGROUND OF THE INVENTION

This invention relates to bag squeezing apparatus, and, more particularly, this invention relates to bag squeezing or impacting apparatus for facilitating break-up of material in a bag for gravity delivery of the material from the bag.

Raw materials or processed intermediate materials are often stored in plastic bags. Woven polypropylene super-bags or super-sacs can contain a thousand to two thousand pounds. When the material is granular or lumped material, such as a clay or a polymer, it tends to stick together or form bridges of solid material inhibiting flow and emptying of the bags. The bags are typically handled by hand, emptying the contents into a hopper for further processing. When bridging blockage occurs, the problem is usually dealt with in an inefficient manner by beating against the bags with a bar or lever.

SUMMARY OF THE INVENTION

The present invention provides apparatus for facilitating the gravity emptying of bags by breaking up any bridging of the material occurring in the bags. The bags are supported over a delivery hopper and a pair of jaws are mounted on spaced parallel axes at the midpoint of each jaw. A motor is attached to the lower end of each jaw to pivot the upper working end of the jaw towards each other to impact the bag on opposite sides. In the preferred form of the invention, the motor is a pneumatic cylinder with the piston rod end connected to the lower end of one of the pair of jaws and the casing end of the cylinder connected to the lower end of the other jaw.

With this arrangement, the working end of one jaw will impact the bag on one side followed by the other jaw impacting the other side of the bag. This efficiently breaks up the bridges, and the operation of the jaws can be conveniently in single cycle pulses.

In a preferred form, each of the jaws includes a pair of parallel spaced lever arms joined by a plurality of spaced contact bars. A pneumatic cylinder is connected between one of the pair of lever arms of each jaw at each side of the jaws so that two cylinders act in parallel to sequentially impact the jaws against opposite sides of the bag.

BRIEF DESCRIPTION OF THE DRAWING

The advantages of the present invention will be more apparent from the following detailed description when considered in connection with the accompanying drawing wherein:

FIGS. 3–5 are like side elevational views of the apparatus showing sequential operation wherein:

FIG. 3 shows the jaws apart before and after actuation of the cylinders;

FIG. 4 shows one of the jaws having impacted a bag as the cylinders are being actuated; and FIG. 5 shows the other jaw impacting the bag as the cylinder is further actuated.

DETAILED DESCRIPTION OF THE PREFERRED EMBODIMENT

Figure 1:
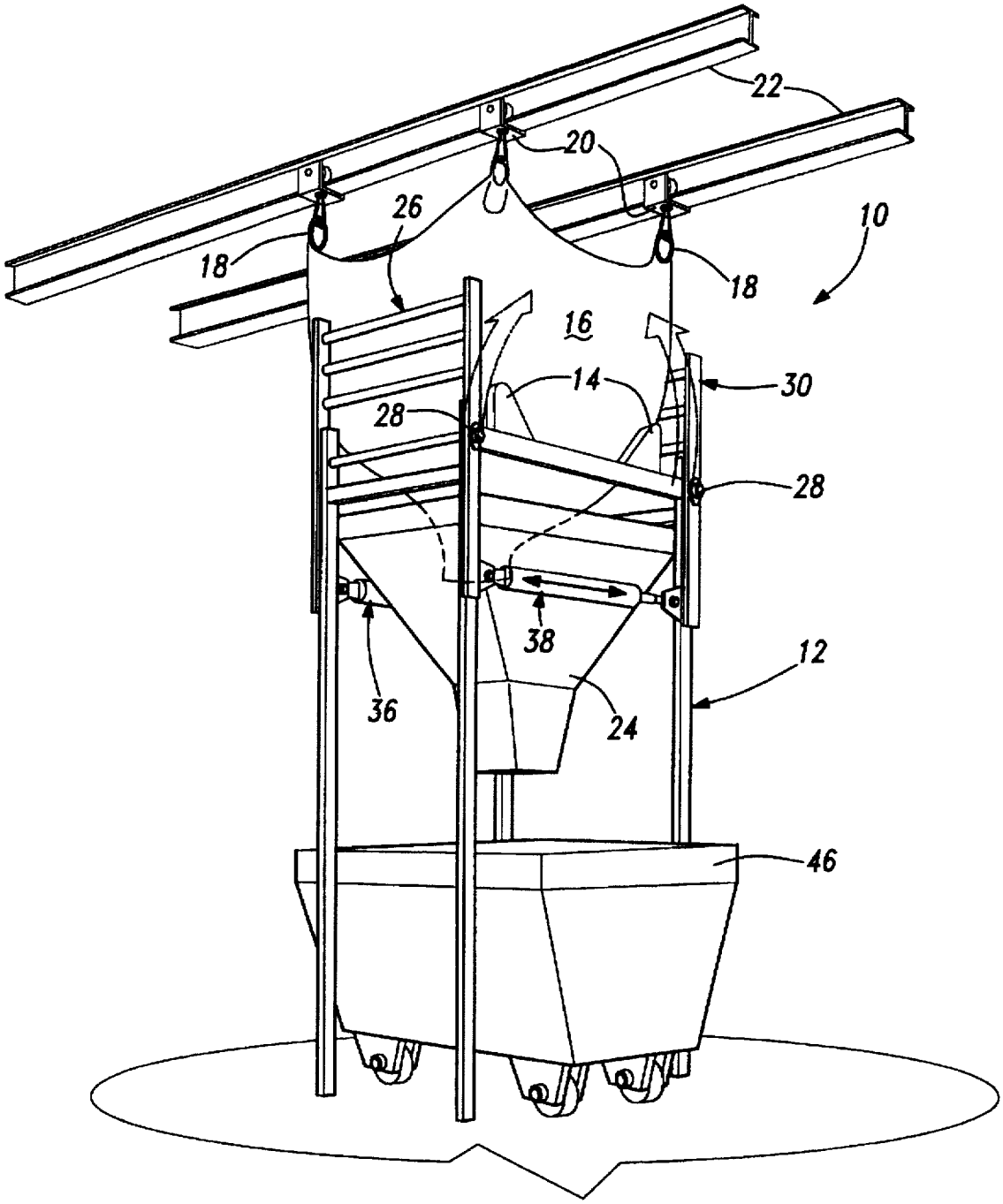
FIG. 1 is a perspective view of the bag squeezing apparatus of this invention showing a bag being emptied supported above a collection hopper.

Referring to FIG. 1, the bag squeezer apparatus of the invention includes a rectangular frame structure 12 having supporting ears 14 at its upper four corners, two of which can be seen in FIG. 1. The bag 16 of material to be emptied is supported on the ears 14. Super-bags usually have corner loops 18 which are shown also supporting the bag from hanging support members 20 on beams 22. Either or both support ears 14 and support members 20 can be used. The open end of the bag 16 projects into delivery hopper 24 also mounted on the frame structure 12.

Figure 2:
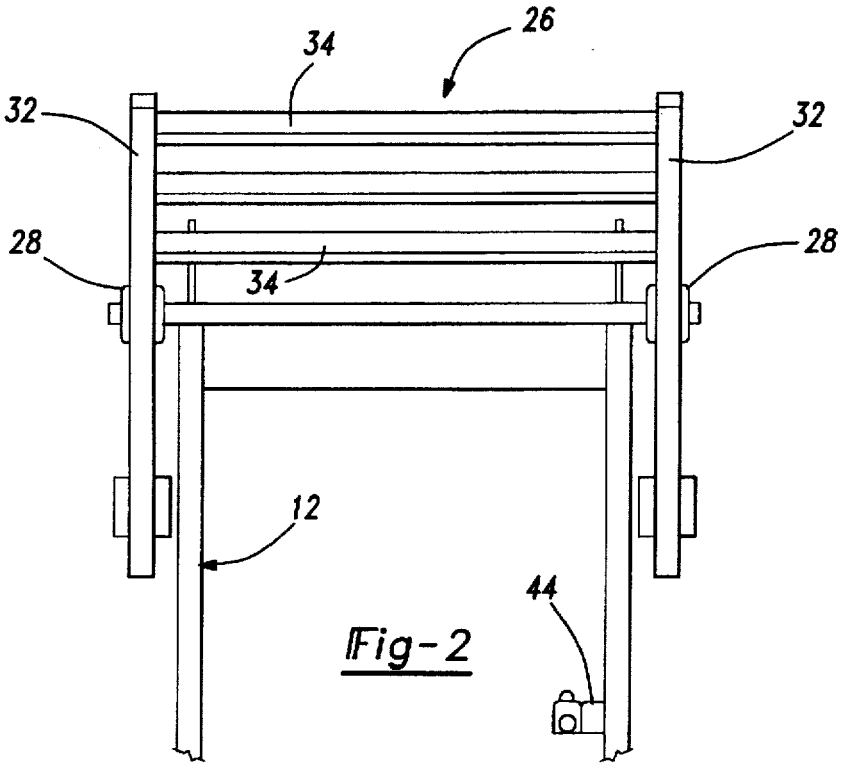
FIG. 2 is an end elevational view of a portion of the apparatus of FIG. 1 showing the jaw construction.
Figure 3:
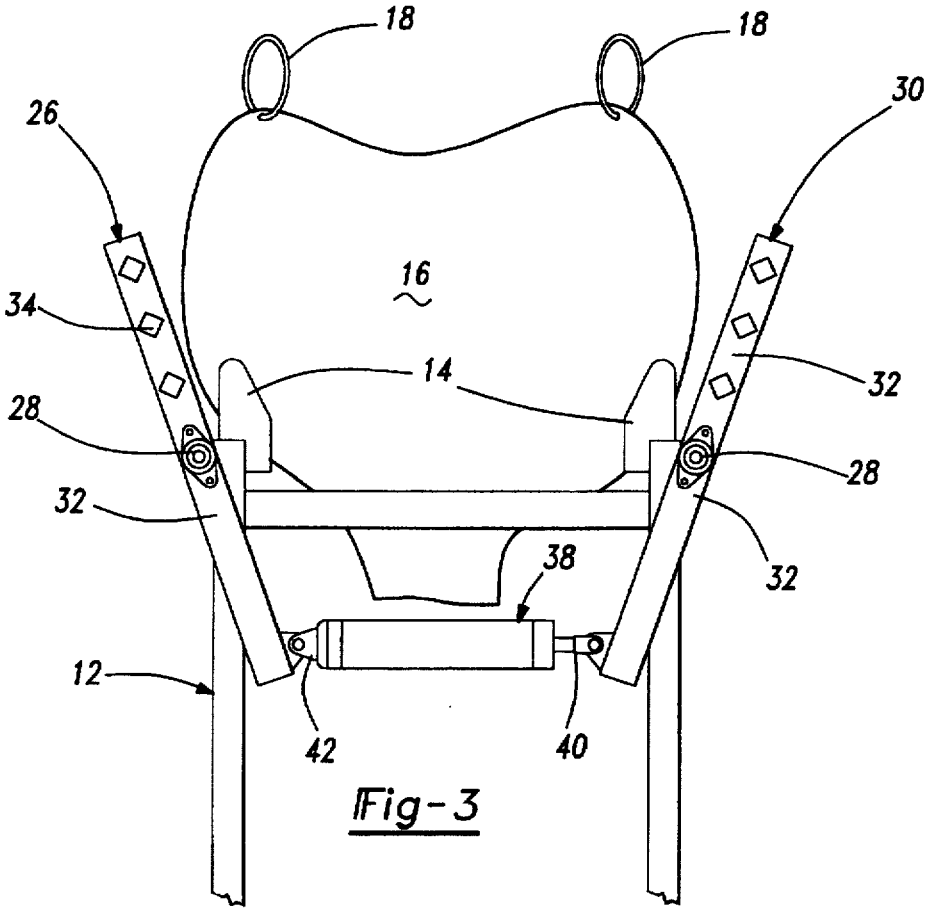

Referring to FIGS. 1–3, the bag squeezer has a pair of opposed jaws 26 and 30 mounted to the frame 12 on spaced parallel axes with bearings 28. Each of the jaws 26 and 30 have a pair of lever arms 32 joined at their upper ends by spaced square tubing members 34 which act as contact bars. The bearings 28 are located at a midpoint of the lever arms 32.

The lower ends of lever arms 32 are joined by pneumatic cylinders 36 and 38. As seen in FIG. 3, the piston rod 40 of the cylinder 38 is pivotally connected to the lower end of the right hand lever arm 32 of jaw 30, and the casing 42 of cylinder 38 is pivotally connected to the lower end of the left hand lever arm 32 of jaw 26. Similar connections are made between the lever arms 32 of jaws 26 and 30 and the pneumatic cylinder 36.

With this connection of the actuating cylinders to the jaws, we have achieved a very desirable squeezing or impacting action on the bag: namely, rapidly impacting one side and then the other side of the bag which is very effective in breaking up bridged clumps of material in the bag.

Both cylinders 36 and 38 are connected in a conventional arrangement in parallel to a source of pressurized air so that they will be working in the same manner at the same time. Thus, by observing the action of cylinder 38 in FIGS. 3–5, the observer will appreciate cylinder 36 will be operating in the same manner.

In the "at rest" position of FIG. 3, before air pressure is applied, the piston rod 40 will be fully retracted and both jaws 26 and 30 will be in the open position shown, out of contact with the bag.

Figure 4:
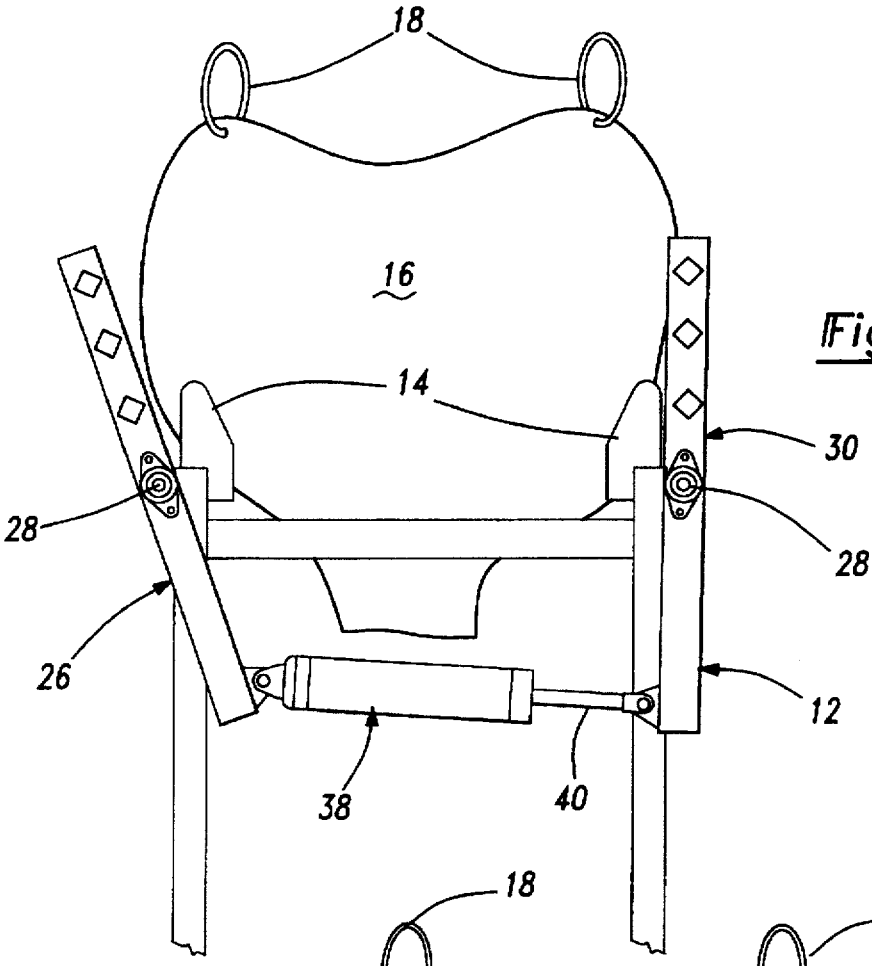

As air is applied to the cylinder 38, as shown in FIG. 4, the piston rod 40 will start to extend, impacting the right hand jaw 30 against the right side of the bag 16.

Figure 5:
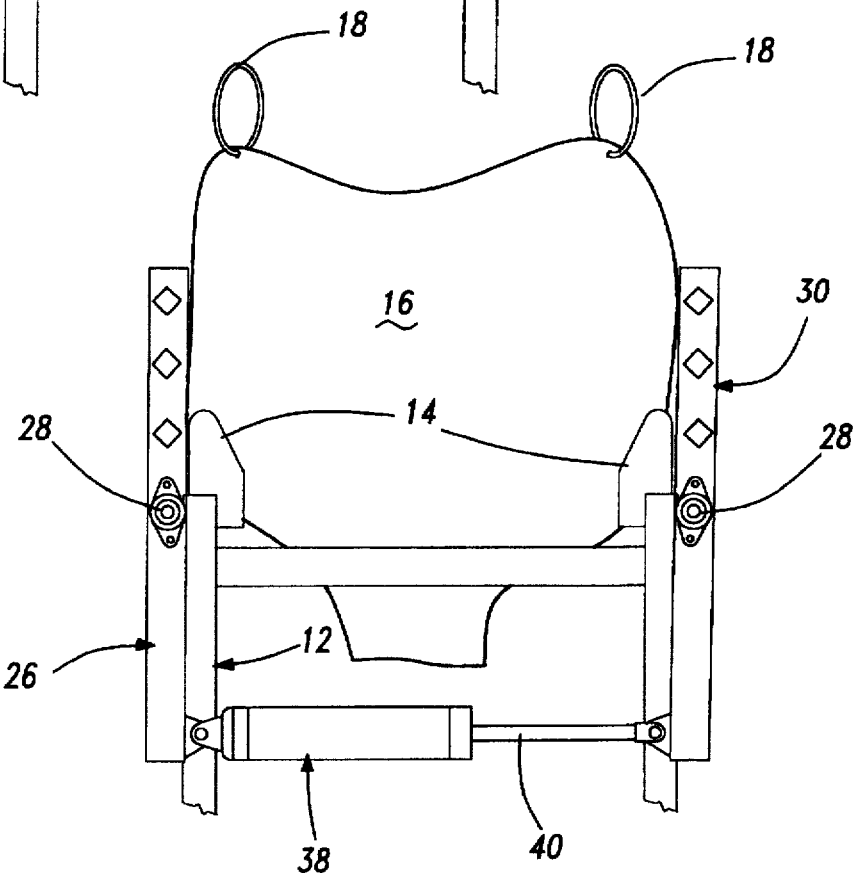

As the piston rod 40 moves out farther, as shown in FIG. 5, with the jaw 30 remaining in contact with the bag 16, the left hand jaw 26 will impact against the left side of the bag. This rapid sequential impacting breaks up the bridging.

When the air pressure is removed from the cylinder, the piston rod 40 will retract, returning the jaws 26 and 30 to their open position shown in FIG. 3. It will be appreciated that the cylinders 36 and 38 can be spring return single acting cylinders or they can be double acting cylinders so that air will be applied to the other side of the cylinder for return, all as is well known in the art.

In the preferred form of the invention, we prefer to manually actuate the cylinders for single cycle operation, repeating the impacting cycle as often as necessary to continue gravity flow of material out of the bag. For this purpose, a push button solenoid operator 44 can be conveniently located on the frame 12 as seen in FIG. 2.

The collecting or delivery hopper 24 can be connected directly to a processing unit such as plastic extruder, or it can be arranged to deliver to a conveyor as indicated by the wheel conveyor bin 46 in FIG. 1.

It will be appreciated that the operating arc of the jaws as well as the jaw configuration, and other features can be altered to meet the specific needs of the bag squeezer for different installations.

We claim:

1. A bag squeezing apparatus for facilitating break-up of material in a bag for gravity delivery of the material from the bag comprising:

a frame;

a bag support mounted to said frame having at least two ears for supporting said bag over a center opening, said at least two ears spaced apart on opposite sides of said center opening;

a pair of jaw members mounted to said frame, said jaw members pivotable about one of a respective pair of spaced parallel horizontal axes, said at least two ears of said bag support and said center opening being disposed between said pair of horizontal axes; and a motor attached to each jaw member to independently pivot working ends of the jaw members toward each other to impact said bag on opposite sides, said motor is attached to said jaw members in a manner to sequentially impact a working end of one of said pair of jaw members against one side of said bag at a position above said bag support and then to impact a working end of the other of said pair of jaw members against an opposite side of said bag at a position above said bag support.

2. Apparatus according to claim 1 wherein said motor comprises a fluid actuated extensible cylinder.

3. Apparatus according to claim 2 wherein a piston rod at one end of said cylinder is connected to a lower end of one of said pair of jaw members and a casing end of said cylinder is connected to a lower end of the other of said pair of jaw members.

4. Apparatus according to claim 1 wherein each of said jaw members includes a pair of parallel spaced lever arms joined by a plurality of spaced contact arms at an upper end of each lever arm to constitute the working end of each of said jaw members.

5. Apparatus according to claim 4 wherein the lever arms of each jaw member are pivotally connected at a midpoint to said frame.

6. Apparatus according to claim 5 wherein a lower end of one of said pair of lever arms of each jaw member is attached to said motor.

7. Apparatus according to claim 6 wherein a lower end of the other of said pair of lever arms of each jaw member is attached to a second motor.

8. Apparatus according to claim 7 wherein said motor and said second motor comprise fluid actuated extensible cylinders with connections being made between the lower ends of said lever arms and a piston rod at one end of each of said cylinders and to a casing end at the other end of each of said cylinders.

9. A bag squeezing apparatus for facilitating break-up of material in a bag for gravity delivery of the material from the bag comprising:

a frame;

a bag support;

a pair of jaw members mounted on spaced parallel axes on opposite sides of the bag support, said pair of jaw members including a pair of parallel spaced lever arms joined by a plurality of spaced contact arms at an upper end of each lever arm to constitute the working end of each of said jaw members; and a motor attached to each jaw member to pivot working ends of the jaw members toward each other to impact said bag on opposite sides.

10. Apparatus according to claim 9, wherein said motor comprises a fluid actuated extensible cylinder.

11. Apparatus according to claim 10, wherein a piston rod at one end of said cylinder is connected to a lower end of one of said pair of jaw members and a casing end of said cylinder is connected to a lower end of the other of said pair of jaw members.

12. Apparatus according to claim 9, wherein the lever arms of each jaw member are pivotally connected at a midpoint to a frame.

13. Apparatus according to claim 12, wherein a lower end of one of said pair of lever arms of each jaw member is attached to said motor.

14. Apparatus according to claim 13, wherein a lower end of the other of said pair of lever arms of each jaw member is attached to a second motor.

15. Apparatus according to claim 14, wherein said motor and said second motor comprise fluid actuated extensible cylinders with connections being made between the lower ends of said lever arms and a piston rod at one end of each of said cylinders and to a casing end at the other end of each of said cylinders.

* * * * *